US011236647B2

(12) United States Patent
Altherr et al.

(10) Patent No.: US 11,236,647 B2
(45) Date of Patent: Feb. 1, 2022

(54) SLOTTED GUIDE

(71) Applicant: Mahle International GmbH, Stuttgart (DE)

(72) Inventors: Patrick Altherr, Stuttgart (DE); Thorsten Ihne, Stuttgart (DE); Rolf Kirschner, Esslingen (DE); Mario Mohler, Stuttgart (DE); Markus Walch, Bretten (DE)

(73) Assignee: Mahle International GmbH

( * ) Notice: Subject to any disclaimer, the term of this patent is extended or adjusted under 35 U.S.C. 154(b) by 131 days.

(21) Appl. No.: 16/817,590

(22) Filed: Mar. 12, 2020

(65) Prior Publication Data

US 2020/0291830 A1 Sep. 17, 2020

(30) Foreign Application Priority Data

Mar. 13, 2019 (DE) ..... 102019203429.2

(51) Int. Cl.
*F01L 13/00* (2006.01)
*F01L 31/18* (2006.01)
*F01L 31/16* (2006.01)

(52) U.S. Cl.
CPC ..... *F01L 13/0042* (2013.01); *F01L 31/16* (2013.01); *F01L 31/18* (2013.01)

(58) Field of Classification Search
CPC ..... F01L 13/0042; F01L 31/18; F01L 31/16; F01L 2303/00; F01L 13/0036; F01L 13/06; F01L 2305/00; F01L 1/181; F01L 1/12; F01L 1/047; F01L 1/18
See application file for complete search history.

(56) References Cited

U.S. PATENT DOCUMENTS 8,191,524 B2 6/2012 Elendt et al.
8,353,264 B2 * 1/2013 Meintschel ..... F01L 1/053 123/90.18
8,418,667 B2 * 4/2013 Nendel ..... F01L 13/0036 123/90.6
8,616,167 B2 12/2013 Nendel
9,765,659 B2 * 9/2017 Walther ..... F01L 13/0036
11,041,416 B2 * 6/2021 Altherr ..... F01L 1/053
(Continued)

FOREIGN PATENT DOCUMENTS

DE 102009006632 A1 8/2010
DE 202009016619 U1 9/2010
(Continued)

OTHER PUBLICATIONS

English abstract for DE-102009006632.
English abstract for DE-102013208364.
English abstract for DE-102016209600.

*Primary Examiner* — Sizo B Vilakazi
(74) *Attorney, Agent, or Firm* — Fishman Stewart PLLC

(57) ABSTRACT

The present disclosure concerns a slotted guide of a valve train of an internal combustion engine. The slotted guide includes two guide tracks, which cross one another in a crossing region, for guiding a switching pin of a cam follower of the valve train. The two guide tracks have an on-track region, a crossing region, and an off-track region. At least one radial projection, structured and arranged to protrude beyond the slotted guide in a radial direction, is provided in or downstream from the off-track region of at least one guide track.

20 Claims, 1 Drawing Sheet

(56) References Cited

U.S. PATENT DOCUMENTS

| | | | | |
|---|---|---|---|---|
| 11,047,270 | B2 * | 6/2021 | Altherr | F01L 13/0036 |
| 2010/0126447 | A1 * | 5/2010 | Talan | F01L 13/0036 123/90.17 |
| 2010/0224154 | A1 * | 9/2010 | Elendt | F01L 13/0036 123/90.17 |
| 2018/0230862 | A1 | 8/2018 | Altherr | |
| 2020/0291829 | A1 * | 9/2020 | Altherr | F01L 1/267 |
| 2020/0291831 | A1 * | 9/2020 | Altherr | F01L 1/053 |
| 2020/0308997 | A1 * | 10/2020 | Altherr | F01L 1/267 |

FOREIGN PATENT DOCUMENTS

| | | | |
|---|---|---|---|
| DE | 102010024030 | A1 | 12/2011 |
| DE | 102013208364 | A1 | 11/2013 |
| DE | 202015009047 | U1 | 8/2016 |
| DE | 102016209600 | A1 | 12/2017 |

* cited by examiner

SLOTTED GUIDE

CROSS-REFERENCE TO RELATED APPLICATION

This application claims priority to German Application No. DE 10 2019 203 429.2 filed on Mar. 13, 2019, the contents of which are hereby incorporated by reference in its entirety.

TECHNICAL FIELD

The present invention relates to a slotted guide comprising two guide tracks, which cross one another in a crossing region, for guiding a switching pin of a cam follower of a valve train. The invention furthermore relates to a valve train comprising a slotted guide of this type as well as to an internal combustion engine comprising a valve train of this type.

BACKGROUND

A generic slotted guide is generally used in the case of a valve train of an internal combustion engine, in the case of which the inlet times or the outlet times of an inlet or outlet valve are to be influenced. The switchover from a normal cam profile to a brake cam profile is also conceivable in this context, whereby a braking operation of an internal combustion engine equipped therewith can be controlled, To be able to thereby change between the different cam profiles, whereby a turn-off of a cylinder can, for example, also be made possible, a so-called displacement bolt system is often provided, in the case of which a switching pin of a cam follower is guided in a generic slotted guide comprising two guide tracks, which cross one another in a crossing region.

It may be disadvantageous thereby, however, that in the case of functionally optimized cam contours, the ejection of the switching pin and thus the transfer into the other guide track are made more difficult or are not possible at all. The reason for this is the reduced time or distance, respectively, which is available in the case of a slotted guide comprising two guide tracks, which cross one another. This is so, because the ejection of the switching pin has to thereby take place immediately after the lift switch-over, whereby the tilt lever, together with switching pin, is already in an upwards movement immediately after the profile switch-over in the case of a functionally optimized selection of a brake cam profile, which prevents the ejection of the switching pin from the respective guide track comprising a conventional ejection contour.

The present invention thus deals with the problem of specifying an improved or at least an alternative embodiment for a slotted guide of the generic type, which in particular overcomes the disadvantages known from the prior art.

This problem is solved according to the invention by means of the subject matter of the independent claim(s). Advantageous embodiments are subject matter of the dependent claims.

SUMMARY

The present invention is based on the general idea of providing a radial projection at the slotted guide, which protrudes from the actual switching contour plane and which newly creates, increases, or extends, respectively, an ejection contour by means of this material application, whereby an ejection of the switching pin is also made possible in response to an upwards movement of the tilt lever or of the cam follower, respectively, thus in the case of a smaller immersion depth of a switching pin into the corresponding guide track. The slotted guide according to the invention thereby has two guide tracks, which cross one another in a crossing region, for guiding the switching pin of the cam follower or of the tilt lever, respectively, of a valve train of an internal combustion engine, wherein each guide track can have lateral edges. Each guide track furthermore has an on-track region, a crossing region located in the region of a crossing point, as well as an off-track region, wherein a depth of the guide track can increase from the on-track region up to the crossing region and can then decrease again up to the off-track region. According to the invention, at least one radial projection, which protrudes beyond the slotted guide in the radial direction, is now provided in or downstream from the off-track region (in the direction of rotation) of at least one guide track, whereby the switching pin can be ejected more easily and more reliably even in response to an upwards movement of the cam follower or of the tilt lever, respectively. In particular a reliable mode of operation of a valve train, which is equipped with a slotted guide of this type, and thus of an internal combustion engine, which is equipped with a valve train of this type, can be attained thereby, without requiring larger structural changes or higher costs for that purpose. With the radial projection according to the invention, a special structural feature in the case of an X-groove can be considered, namely that only a small angular range is available for the ejection of the switching pin, so that the ejection has to take place later. The tilt lever is already raised by the beginning cam lift in the corresponding angular range, the positive radial (ejection) projection thereby additionally supports an ejection of the switching pin.

In the case of an advantageous further development of the invention, the radial projection connects directly to the off-track region of at least one guide track, so that the projection represents an extension of the off-track region. An ejection of the switching pin, which is guided in the guide track, is thereby also possible in the case of an immersion depth, which is small or not present, in the corresponding guide track. The radial projection is arranged at a base of the guide track in the off-track region in this case.

A width and an axial position of the at least one radial projection on the bolt advantageously corresponds to a width and an axial position of at least one guide track, so that the switching pin, which is guided in the guide track, can come into contact with the projection in and downstream from the off-track region on the front side. The radial projection is thus arranged so as to be essentially aligned with the respective guide track in the circumferential direction.

In the case of an alternative embodiment, a width of the radial projection downstream from the off-track region is larger than the width of the corresponding guide track. The radial projection thus does not only continue in alignment with the guide track in the circumferential direction, but can also continue in alignment in the edges, which laterally limit this guide track. A widened and thus also improved ejection option is thereby created for the switching pin.

Again in the alternative, it can be provided that the radial projection extends over the entire width of the slotted guide, that is, the axial length of the slotted guide, and is interrupted by maximally one guide track, so that the number of the resulting undercuts is minimized. A simplified machining, e.g. of forging blank, which already has the projection, can be made possible thereby, in that the same projected outer contour is always at hand, if possible, in the case of lateral top view onto the part.

Advantageously, it is possible that the radial projection is only located on at least one edge in the off-track region of at least one guide track, and that the switching pin, which is guided in the guide track, has a shoulder, which can come into contact with the projection on the edge of the guide track. An improved ejection option only over the edge of the guide track can be created thereby. A local machining is thereby conceivable, in particular a built circular groove blank (guide track) comprising projection of separate component, which is attached laterally to circular groove blank, is conceivable.

In the case of an advantageous further development of the solution according to the invention, the on-track region is arranged offset to the off-track region by an angle $\alpha$ of $90° < \alpha < 120°$, in particular by an angle $\alpha$ of approx. 110°. An intermediate region of essentially only between 90° and 120°, in which the change between the two guide tracks has to take place as well, thus remains between the on-track region and the off-track region and opposite to the crossing region. The changing between the guide tracks thus has to take place essentially within one-fourth of a rotation of the slotted guide, for the purpose of which a reliable ejection of the switching pin from the preceding guide track is absolutely required. By means of the radial projection, which is provided according to the invention, it is thereby even possible in particular to design the guide track-free angular range located between on-track and off-track region to be smaller, because a changing can take place more quickly.

In the case of a further advantageous embodiment of the solution according to the invention, the radial projection extends over an angular range $\beta$ of $5° < \beta < 20°$, in particular by an angle $\beta$ of approx. 10°. However, the projection, which is comparatively small in the circumferential direction, is already sufficient to reliably move the switching pin out of the guide track, whereby the material application required for this purpose is marginal, so that virtually no imbalances and virtually no additional costs are created.

In the case of an advantageous further development of the solution according to the invention, a maximum depth $t_{max}$ of a guide track is between 10 and 15% of a maximum outer diameter D of the slotted guide. A reliable and correct guidance of the respective switching pin in the guide track can be attained thereby.

The present invention is further based on the general idea of specifying a valve train for an internal combustion engine, which has an above-described slotted guide on a camshaft. The camshaft itself has at least one cam follower, which cooperates with the camshaft and which can be axially adjusted, for example a tilt lever, wherein a switching pin is arranged perpendicular to a cam follower longitudinal axis in the respective cam follower. Via this switching pin, the cam follower cooperates with the guide tracks of the slotted guide in such a way that the cam follower in the first guide track cooperates with a first cam and in the second guide track cooperates with a second cam or taps the latter, respectively. In particular inlet and outlet times of individual valves or also a cylinder turn-off can be realized comparatively easily through this. With the use of the slotted guide according to the invention in the valve train according to the invention, a quick and functionally reliable extending of the switching pin out of the respective guide track can also be attained.

Advantageously, the slotted guide is connected in a rotationally fixed manner to the camshaft via a thermal joint seat. Thermal joint seats of this type are already well-known for the rotationally fixed fixation of components on camshafts and can thus be realized reliably. With a thermal joint seat of this type, a simultaneous joining of the slotted guide with the cams can additionally take place, whereby the production process can be streamlined and the assembly costs can be reduced.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the following description, whereby identical reference numerals refer to identical or similar or functionally identical components.

BRIEF DESCRIPTION OF THE DRAWINGS

In each case schematically.

DETAILED DESCRIPTION

Figure 1:
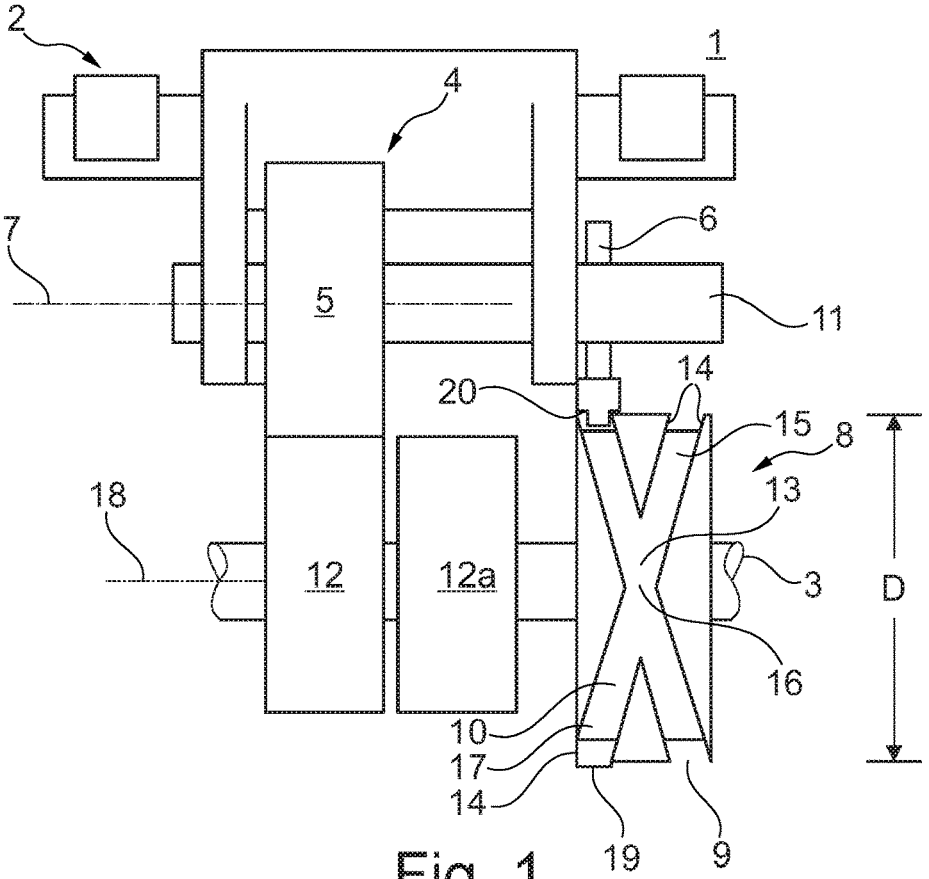
FIG. 1 shows a valve train according to the invention of an internal combustion engine according to the invention, comprising a slotted guide according to the invention.

According to FIG. 1, an internal combustion engine 1 according to the invention has a valve train 2 according to the invention, as well as a camshaft 3, on which at least one cam follower 4 is arranged, which cooperates with the camshaft 3 and which is axially adjustable, here a cam roller 5. A switching pin 6 is arranged perpendicular to a cam follower longitudinal axis 7 in the cam follower 4, wherein the switching pin 6 cooperates with a slotted guide 8 according to the invention, which is arranged on the camshaft 5 (see also FIGS. 2 and 3). Cooperating means in this case that the switching pin 6 alternately engages with a first guide track 9 and a second guide track 10 and thereby effects a longitudinal adjustment of the cam follower 4 or of the cam roller 5, respectively, in the direction of the cam follower longitudinal axis 7, whereby the cam roller 5 is rotatably arranged on a bolt 11 of the cam follower 4. By means of an axial longitudinal displacement of the cam roller 5 by guiding the switching pin 6 in the first or second guide track 9, 10, respectively, the cam follower 4 can tap cam profiles of a first cam 12 and of a second cam 12*a*, which is axially adjacent thereto. In particular an influencing of an inlet time or of an outlet time, respectively, of a non-illustrated inlet or outlet valve can be influenced thereby or a cylinder turn-off can be realized as well.

Figure 2:
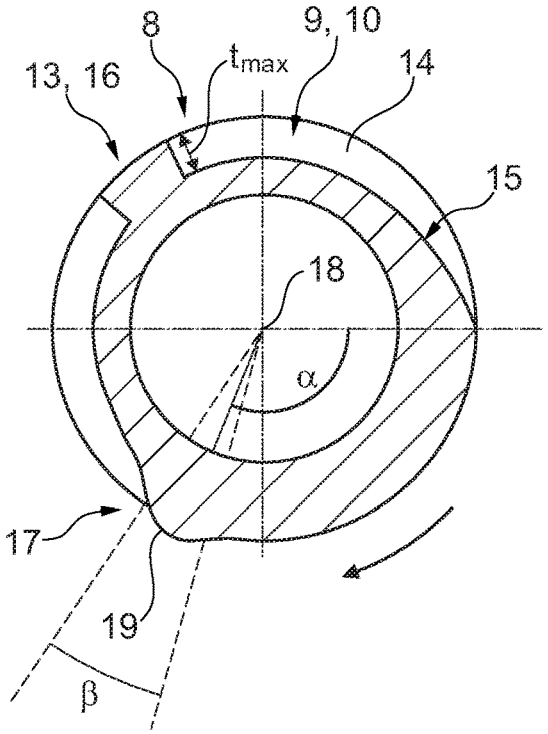
FIG. 2 shows a sectional illustration through the slotted guide according to the invention.

When now looking at the slotted guide 8 according to the invention in more detail, it can be seen that the two guide tracks 9, 10 for guiding the switching pin 6 cross one another in a crossing point 13, wherein each guide track 9, 10 is limited by lateral edges 14. Each guide track 9, 10 furthermore has an on-track region 15 (see FIG. 2), a crossing region 16 located in the region of the crossing point 13, as well as an off-track region 17, wherein a depth t increases or can increase, respectively, measured radially to an axis 18 of the slotted guide 8 from the on-track region 15 to the crossing region 16, and then decreases or can decrease again, respectively, up to the off-track region 17. To now realize an ejection of the switching pin 6 from the respective guide track 9, 10 and thus a quicker switch-over of the cam tap between the cam 12 and cam 12*a*, at least one radial projection 19 (see FIG. 2), which protrudes beyond the slotted guide 8 in the radial direction, is provided in the off-track region 17 or downstream therefrom in the direction of rotation of at least one guide track 9, 10, whereby the switching pin 8 can be ejected more easily and more reliably even in response to an upwards movement of the cam follower 4 or of the tilt lever, respectively. For clarity, the radial projection 19 in FIG. 2 is illustrated in an exaggerated manner. In particular a reliable mode of operation of a valve train 2, which is equipped with a slotted guide 8 of this type, can be attained thereby without requiring larger structural changes or higher costs for that purpose.

Different embodiments are to be differentiated thereby, for example one, in the case of which the radial projection 19 connects directly to the off-track region 17 of at least one guide track 9, 10, so that the projection 19 represents an extension of the off-track region 17, whereby an ejection of the switching pin 6, which is guided in the guide track 9, 10, is possible even in the case of an immersion depth, which is small or not available, in the corresponding guide track 9, 10.

It can be provided thereby that a width a width and an axial position of the at least one radial projection 19 corresponds to a width and to an axial position of at least one guide track 9, 10, so that the switching pin 6, which is guided in the guide track 9, 10, can come into contact with the projection on the front side. The radial projection 19 is thus arranged so as to be essentially aligned with the respective guide track 9, 10 in the circumferential direction.

In the alternative, it can also be provided that a width of the radial projection 19 downstream from the off-track region 17 is larger than the width of the corresponding guide track 9, 10. In this region, the radial depth t of the guide track is already negative. In this region, the radial projection 19 even extends in alignment with the edges 14. The radial projection 19 can thereby extend over the entire width of the slotted guide 8 and can be interrupted by maximally one guide track 9, 10, so that the number of the resulting undercuts is minimized.

In the alternative, a radial projection 19 (see FIG. 3) is provided on an edge 14 of the guide track 9, 10 in the off-track region 17, via which the pin 6 is supported via a corresponding shoulder 20 (see FIG. 1) and can thus be ejected better. The radial projection 19 thus emerges from the actual switching gate in the radial direction, whereby an ejection contour can be increased or extended, respectively. This in particular also provides for a reliable and secure ejection of the switching pin 6 from the respective guide track 9, 10 in response to an upwards movement of a tilt lever or of the cam follower 4, respectively. The radial projection 19 can thereby be provided on only a single edge 14 or on at least two edges 14 of the respective ejection region 17. The radial projection 19 can be heat-treated or coated, in particular by means of electron beam hardening, laser hardening or a nitriding process.

When looking at FIG. 2 more closely, it can be seen that the on-track region 15 is arranged offset to the off-track region 17 by and angle $\alpha$ of $90° < \alpha < 120°$, in particular by an angle $\alpha$ of approx. 110°. According to a further advantageous embodiment of the solution according to the invention, the radial projection 19 extends over an angle $\beta$ of between 5° and 20°, in particular over an angle $\beta$ of approx. 10°. A reliable ejection of the switching pin 20 can be attained thereby on the one hand, without creating an excessive imbalance of the camshaft 3 by means of a material application, which is larger and longer in the circumferential direction.

A maximum depth $t_{max}$ (measured in the radial direction) of a guide track 9, 10 is thereby between 10 and 15% of a maximum outer diameter D of the slotted guide 8, whereby a material reduction and thus a reduction of the weight can be attained on the one hand, and a reliable guidance of the switching pin 6 in the respective guide track 9, 10 can be effected on the other hand.

Figure 3:
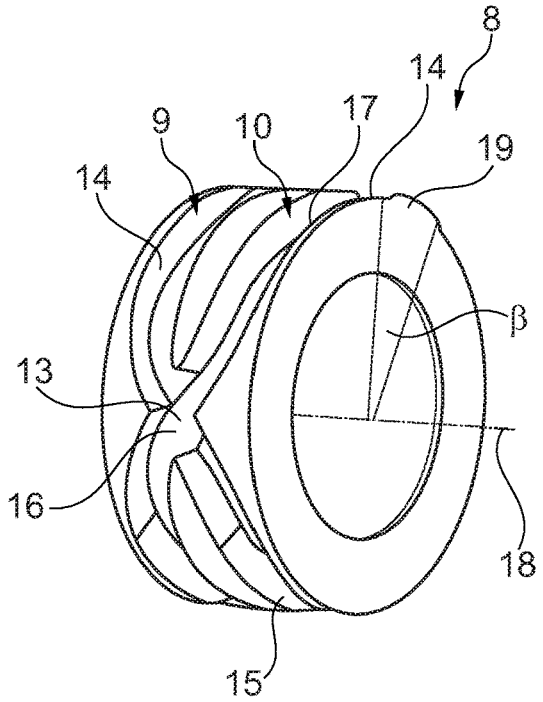
FIG. 3 shows a view onto a slotted guide according to the invention.

As illustrated according to FIGS. 1 to 3, the slotted guide 8 is formed as slotted guide sleeve and is thus able to be fixed to the camshaft 3, for example by means of a thermal joining process and a shrink fit resulting therefrom. It goes without saying that further fixing options are also conceivable.

As a whole, a reliable ejection of the switching pin 6 from the guide track 9, 10 can be made possible by means of the slotted guide 8 according to the invention, even in response to an upwards movement of the tilt lever or of the cam follower 4, respectively, whereby in particular an ejection of the switching pin 6 in the case of a brake cam profile, in the case of which the cam follower 4, together with switching pin 6, is already in an upwards movement, immediately downstream from the profile switchover, are ensured. This is not possible without problems with current slotted guides, which are known from the prior art.

The invention claimed is:

1. A slotted guide, comprising:

two guide tracks, structured and arranged to cross one another in a crossing region, for guiding a switching pin of a cam follower of a valve train of an internal combustion engine, wherein each of the two guide tracks has an on-track region, a crossing region, and an off-track region; and at least one radial projection, structured and arranged to protrude beyond the slotted guide in a radial direction, provided in or downstream from the off-track region of at least one guide track of the two guide tracks.

2. The slotted guide according to claim 1, wherein the at least one radial projection connects directly to the off-track region of the at least one guide track and defines an extension of the off-track region, such that an ejection of the switching pin guided therein is also possible in the case of an immersion depth, which is small or not present, in the at least one guide track.

3. The slotted guide according to claim 2, wherein a width and an axial position of the at least one radial projection corresponds to a width and an axial position of the at least one guide track, such that the switching pin can come into contact with the at least one radial projection on a front side.

4. The slotted guide according to claim 2, wherein a width of the at least one radial projection, which is arranged downstream from the off-track region, is larger than a width of the at least one guide track.

5. The slotted guide according to claim 4, wherein the at least one radial projection extends over an entire width of the slotted guide and is interrupted by maximally one of the two guide tracks.

6. The slotted guide according to claim 2, wherein the at least one radial projection is only located on at least one edge of the at least one guide track, and wherein the switching pin has a collar or a widening that comes into contact with the at least one radial projection on the at least one edge of the at least one guide track.

7. The slotted guide according to claim 1, wherein the on-track region is arranged offset to the off-track region by an angle $\alpha$ of $90° < \alpha < 120°$.

8. The slotted guide according to claim 1, wherein the at least one radial projection extends over an angle $\beta$ of $5° < \beta < 20°$.

9. The slotted guide according to claim 1, wherein a maximum depth of a respective guide track is between 10 and 15% of a maximum outer diameter of the slotted guide.

10. The slotted guide according to claim 1, wherein at least one of:

the slotted guide is structured as a slotted guide sleeve, and the at least one radial projection is heat-treated or coated.

11. The slotted guide according to claim 1, wherein at least one of:

the two guide tracks each have lateral edges, and a depth of the two guide tracks increases from the on-track region up to the crossing region and then decreases from the crossing region up to the off-track region.

12. A valve train for an internal combustion engine, comprising:

a camshaft and at least one cam follower, wherein the at least one cam follower cooperates with the camshaft via at least two cams and is axially adjustable, a switching pin arranged in the at least one cam follower, a slotted guide arranged on the camshaft for guiding the switching pin, the slotted guide including two guide tracks structured and arranged to cross one another in a crossing region, the two guide tracks each having an on-track region, a crossing region, and an off-track region;

wherein the slotted guide further includes at least one radial projection provided in or downstream from the off-track region of at least one guide track of the two guide tracks, the at least one radial projection protruding beyond the slotted guide in a radial direction; and wherein the switching pin cooperates with the two guide tracks of the slotted guide such that the at least one cam follower is adjusted between a first cam and a second cam of the at least two cams.

13. The valve train according to claim 12, wherein the slotted guide is connected in a rotationally fixed manner to the camshaft via a thermal joint seat.

14. An internal combustion engine, comprising:

a valve train, the valve train including:

a camshaft and at least one cam follower, wherein the at least one cam follower cooperates with the camshaft via at least two cams and is axially adjustable, a switching pin arranged in the at least one cam follower, a slotted guide arranged on the camshaft for guiding the switching pin, the slotted guide including two guide tracks structured and arranged to cross one another in a crossing region, the two guide tracks each having an on-track region, a crossing region, and an off-track region;

wherein the slotted guide further includes at least one radial projection provided in or downstream from the off-track region of at least one guide track of the two guide tracks, the at least one radial projection protruding beyond the slotted guide in a radial direction; and wherein the switching pin cooperates with the two guide tracks of the slotted guide such that the at least one cam follower is adjusted between a first cam and a second cam of the at least two cams.

15. The internal combustion engine according to claim 14, wherein the slotted guide is connected in a rotationally fixed manner to the camshaft via a thermal joint seat.

16. The internal combustion engine according to claim 14, wherein the two guide tracks each have lateral edges.

17. The valve train according to claim 12, wherein the at least one radial projection is disposed on at least one edge of the at least one guide track, and wherein the switching pin has a collar or a widening that comes into contact with the at least one projection on the at least one edge of the at least one guide track.

18. The valve train according to claim 12, wherein a depth of the two guide tracks increases from the on-track region to the crossing region, and decreases from the crossing region to the off-track region.

19. The slotted guide according to claim 1, wherein the on-track region is arranged offset to the off-track region by an angle of approximately 110°.

20. The slotted guide according to claim 1, wherein the at least one radial projection extends over an angle of approximately 10°.

* * * * *